US010930217B2

(12) United States Patent
Zhang

(10) Patent No.: US 10,930,217 B2
(45) Date of Patent: Feb. 23, 2021

(54) METHOD AND APPARATUS FOR COMPENSATING OPERATING PARAMETER OF DISPLAY CIRCUIT

(71) Applicant: BEIJING XIAOMI MOBILE SOFTWARE CO., LTD., Beijing (CN)

(72) Inventor: Yuan Zhang, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 0 days.

(21) Appl. No.: 16/551,193

(22) Filed: Aug. 26, 2019

(65) Prior Publication Data

US 2020/0098317 A1 Mar. 26, 2020

(30) Foreign Application Priority Data

Sep. 26, 2018 (CN) ..... 201811126004.9

(51) Int. Cl.
*G09G 3/00* (2006.01)
*G09G 3/3258* (2016.01)
(Continued)

(52) U.S. Cl.
CPC ..... *G09G 3/3258* (2013.01); *G09G 3/006* (2013.01); *G09G 3/3406* (2013.01); *G09G 5/10* (2013.01);
(Continued)

(58) Field of Classification Search
None
See application file for complete search history.

(56) References Cited

U.S. PATENT DOCUMENTS 8,519,971 B1 8/2013 Mackraz
2004/0108460 A1 6/2004 Ilda et al.
(Continued)

FOREIGN PATENT DOCUMENTS

CN 101452136 A 6/2009
CN 105931596 A 9/2016
KR 20140069725 A 6/2014

OTHER PUBLICATIONS

First Office Action issued to Chinese Patent Application No. 201811126004.9, dated Nov. 11 2019 with Concise Explanation English translation, (6p).
(Continued)

*Primary Examiner* — Brian M Butcher
(74) *Attorney, Agent, or Firm* — Arch & Lake LLP

(57) ABSTRACT

A method and an apparatus are provided for compensating an operating parameter of a display circuit. The method is applied to an electronic device including a display screen and a distance sensor disposed under the display screen, and the method includes: acquiring an operating parameter of a target display circuit on the display screen, the target display circuit being disposed at a position corresponding to a position of the distance sensor; acquiring an operation time period of the distance sensor; acquiring a compensation parameter of the distance sensor according to the operation time period, the compensation parameter of the distance sensor being positively correlated to the operation time period; and compensating the operating parameter of the target display circuit according to the compensation parameter of the distance sensor to acquire a compensated operating parameter of the target display circuit.

18 Claims, 7 Drawing Sheets

(51) Int. Cl.
*G09G 3/34* (2006.01)
*G09G 5/10* (2006.01)

(52) U.S. Cl.
CPC ..... *G09G 2300/043* (2013.01); *G09G 2320/0276* (2013.01); *G09G 2320/043* (2013.01)

(56) References Cited

U.S. PATENT DOCUMENTS

| | | | | |
|---|---|---|---|---|
| 2009/0072734 | A1* | 3/2009 | Harada | H01L 27/3246 313/512 |
| 2016/0011655 | A1* | 1/2016 | Ji | G06F 3/011 345/647 |
| 2017/0045936 | A1* | 2/2017 | Kakapuri | G06F 3/013 |
| 2017/0148376 | A1* | 5/2017 | Yoo | G09G 3/20 |
| 2017/0200427 | A1* | 7/2017 | He | G09G 5/00 |
| 2018/0059774 | A1* | 3/2018 | Lee | G06F 3/011 |
| 2018/0124223 | A1* | 5/2018 | Xie | H04W 52/0254 |
| 2018/0137801 | A1* | 5/2018 | An | G06F 3/013 |
| 2019/0313508 | A1* | 10/2019 | Oda | G09G 5/00 |

OTHER PUBLICATIONS

Extended European Search Report issued to EP Application No. 19199523.2 dated Mar. 3, 2020 (15p).

* cited by examiner

METHOD AND APPARATUS FOR COMPENSATING OPERATING PARAMETER OF DISPLAY CIRCUIT

CROSS REFERENCE TO RELATED APPLICATION

The present application is based on and claims priority to Chinese patent application No. 2018111260049, filed Sep. 26, 2018, the entire disclosure of which is hereby incorporated by reference.

TECHNICAL FIELD

The present disclosure relates to the technical field of display, and more particularly to a method and an apparatus for compensating an operating parameter of a display circuit.

BACKGROUND

With the development of mobile terminals, the full-screen has gradually become the trend of the front surface design of a mobile terminal. When designing a full-screen mobile terminal, a distance sensor P-sensor, which is usually provided on the front surface of the mobile terminal, has been a challenge to manufacturers for improving the screen ratio in the front surface. In the related art, the P-sensor may be disposed under the display screen, and the P-sensor may transmit an infrared light signal through the display screen and receive an infrared light signal reflected from the outside to obtain the distance between an external object and the terminal. Since the infrared light signal emitted by the P-sensor is usually infrared light having a wavelength of less than or equal to 1000 nm. The transistor used in an active-matrix organic light-emitting diode (AMOLED) screen is sensitive to the infrared light with wavelength in this range. Under the interference of the infrared light in this range, the organic light-emitting material of the transistor corresponding to the P-sensor on the display may be damaged, resulting in reduced brightness of the area on the display corresponding to the P-sensor, thereby reducing the display effect and reducing the user experience.

SUMMARY

In order to overcome the problems in the related art, embodiments of the present disclosure provide a method and an apparatus for compensating an operating parameter of a display circuit. The technical solution is as follows.

According to a first aspect of the present disclosure, there is provided a method for compensating an operating parameter of a display circuit, which is applied to an electronic device including a display screen and a distance sensor disposed under the display screen. The method may include: acquiring an operating parameter of a target display circuit on the display screen, the target display circuit being disposed at a position corresponding to a position of the distance sensor; acquiring an operation time period of the distance sensor; acquiring a compensation parameter of the distance sensor according to the operation time period, the compensation parameter of the distance sensor being positively correlated to the operation time period; and compensating the operating parameter of the target display circuit according to the compensation parameter of the distance sensor to acquire a compensated operating parameter of the target display circuit.

According to a second aspect of the present disclosure, there is provided an apparatus for compensating an operating parameter of a display circuit, which is applied to an electronic device including a display screen and a distance sensor disposed under the display screen, and the apparatus including: an operating-parameter acquiring module configured to acquire an operating parameter of a target display circuit on the display screen, the target display circuit being disposed at a position corresponding to a position of the distance sensor; an operation-time-period acquiring module configured to acquire an operation time period of the distance sensor; a sensor-compensation-parameter acquiring module configured to acquire a compensation parameter of the distance sensor according to the operation time period, the compensation parameter of the distance sensor being positively correlated to the operation time period; and an operating-parameter compensating module configured to compensate the operating parameter of the target display circuit according to the compensation parameter of the distance sensor to acquire a compensated operating parameter of the target display circuit.

According to a third aspect of the embodiments of the present disclosure, there is provided an apparatus for compensating an operating parameter of a display circuit, including: a processor; and a memory for storing instructions executable by the processor. The processor is configured to: acquire an operating parameter of a target display circuit on the display screen, the target display circuit being disposed at a position corresponding to a position of the distance sensor; acquire an operation time period of the distance sensor; acquire a compensation parameter of the distance sensor according to the operation time period, the compensation parameter of the distance sensor being positively correlated to the operation time period; and compensate the operating parameter of the target display circuit according to the compensation parameter of the distance sensor to acquire a compensated operating parameter of the target display circuit.

According to a fourth aspect of the present disclosure, there is provided a non-transitory computer readable storage medium having stored thereon a computer instructions, wherein the instructions are executed by a processor, the processor is caused to perform the steps of any method according to the first aspect.

It should be understood that both the foregoing general description and the following detailed description are exemplary and explanatory only and are not restrictive of the disclosure.

BRIEF DESCRIPTION OF THE DRAWINGS

The accompanying drawings, which are incorporated in and constitute a part of this specification, illustrate embodiments consistent with the disclosure and, together with the description, serve to explain the principles of the disclosure.

DETAILED DESCRIPTION

Figure 1:
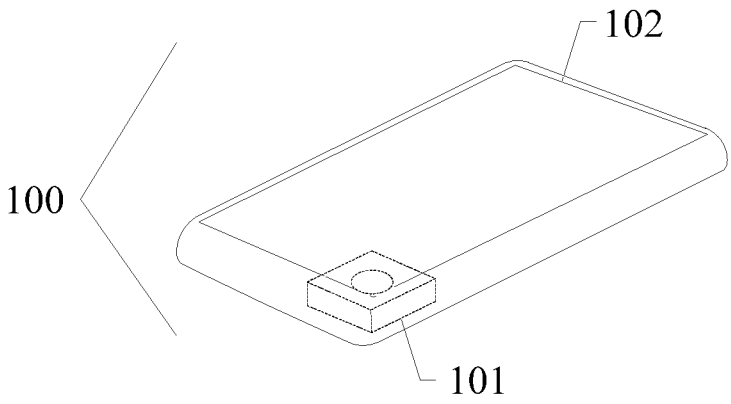
FIG. 1 is a diagram of an application scenario of a method for compensating an operating parameter of a display circuit on according to an exemplary embodiment.

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the disclosure. Instead, they are merely examples of apparatuses and methods consistent with aspects related to the disclosure as recited in the appended claims.

With the rapid development of science and technology and the continuous improvement of people's living standards, in recent years, the full-screen has gradually become the trend of the front surface design of a mobile terminal. When designing a full-screen mobile terminal, a distance sensor P-sensor, which is usually provided on the front surface of the mobile terminal, has been a challenge to manufacturers for improving the screen ratio in the front surface.

In the related art, the P-sensor may be disposed under the display screen, and the P-sensor may transmit an infrared light signal through the display screen and receive an infrared light signal reflected from the outside to obtain the distance between an external object and the terminal.

Since the infrared light signal emitted by the P-sensor is usually infrared light having a wavelength of less than or equal to 1000 nm. The transistor used in an AMOLED screen is sensitive to the infrared light with wavelength in this range. Under the interference of the infrared light in this range, the organic light-emitting material of the transistor corresponding to the P-sensor on the display may be damaged, resulting in reduced brightness of the area on the display corresponding to the P-sensor, thereby reducing the display effect and reducing the user experience.

In order to solve the above problem, in the technical solution provided by the embodiment of the present disclosure, an operating parameter of a target display circuit at a position on a display screen corresponding to the position of the distance sensor is acquired. The target display circuit may be understood as a display circuit that may be influenced or damaged on the display screen when the distance sensor performs distance measurement. An operation time period of the distance sensor is acquired, and a compensation parameter of the distance sensor is acquired according to the operation time period. The compensation parameter of the distance sensor is positively correlated to the operation time period. Therefore, the compensation parameter of the distance sensor can reflect the influence or damage caused to the target display circuit during the distance measurement performed by the distance sensor. The operating parameter of the target display circuit is compensated according to the compensation parameter of the distance sensor to acquire a compensated operating parameter of the target display circuit. Then, when the electronic device controls the target display circuit to display according to the compensated operating parameter, the influence or damage caused to the target display circuit by the distance sensor can be compensated, such that the display effect will not reflect the influence or damage caused to the target display circuit by the distance sensor, thereby improving the user experience.

The technical solution provided by an embodiment of the present disclosure relates to an electronic device 100 shown in FIG. 1. The electronic device 100 includes a distance sensor P-sensor 101 and a display screen 102, and the distance sensor 101 is disposed under the display screen 102. The electronic device 100 may be a mobile phone, a tablet computer, a smart wearable device, etc., which is not limited in this embodiment of the present disclosure. The display screen 102 may be a liquid crystal display (LCD), an organic light emitting diode (OLED) display, or an active-matrix organic light-emitting diode (AMOLED) display screen, etc.

Figure 2A:
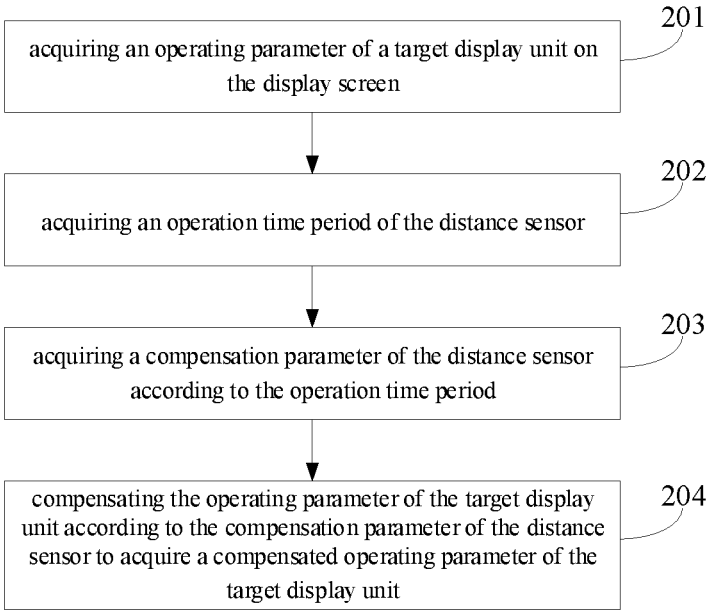
FIG. 2A is a flow chart of a method for compensating an operating parameter of a display circuit according to an exemplary embodiment.

An embodiment of the present disclosure provides a method for compensating an operating parameter of a display circuit, which is applied to an electronic device shown in FIG. 1. As shown in FIG. 2A, the method includes the following steps 201 to 203.

In step 201, an operating parameter of a target display unit on a display screen is acquired.

The target display unit includes a display circuit disposed at a position corresponding to a position of a distance sensor, where the performance of the target display circuit is affected by the distance sensor.

For example, the target display unit may include one or more display circuits adjacent to the distance sensor, each of which may include one or more pixels.

The position of the target display circuit corresponds to the position of the distance sensor, and it can be understood that the target display circuit is located directly above of in a peripheral area directly above the distance sensor. For example, the target display circuit may be located on the display screen in an area centered on the axis center of the sensor, which may be a circular area with a radius of 5 mm centered on the axis center of the distance sensor. When the distance sensor emits an infrared light, the target display circuit is exposed to the infrared light. When the target display circuit is exposed to the irradiation for a long time, damage may occur, causing the target display circuit to have a reduced brightness in displaying an image. In other words, the performance of pixels in the target display circuit may be interfered or degraded by the irradiation from the distance sensor.

For example, the operating parameter of the target display circuit may include an operating voltage of the target display circuit, a brightness value of the target display circuit, a gamma value of the target display circuit, and an operating voltage at the maximum brightness value of the target display circuit. It should be noted that the brightness value of the target display circuit, the gamma value of the target display circuit, and the operating voltage at the maximum brightness value of the target display circuit can also be understood as the brightness value of the display screen where the target display circuit is located, the gamma value of the target display circuit where the target display circuit is located, and the operating voltage at the maximum brightness value of the target display circuit where the target display circuit is located.

In step 202, an operation time period of the distance sensor is acquired.

For example, the operation time period of the distance sensor may be acquired in the following manner. The number of turned-on times of the distance sensor may be accumulated each time the distance sensor is turned on, and the operation time period of the distance sensor is acquired according to the accumulated number of turned-on times and a preset value of a turned-on time period of the distance sensor.

In step 203, a compensation parameter of the distance sensor is acquired according to the operation time period.

The compensation parameter of the distance sensor is positively correlated to the operation time period.

For example, the compensation parameter of the distance sensor is acquired according to the operation time period in the following manner. A query may be performed in a compensation parameter database according to the operation time period, and the compensation parameter of the distance sensor may be determined according to the query result. The compensation parameter database indicates a correspondence relationship between compensation parameters and operation time periods.

In step 204, the operating parameter of the target display circuit is compensated according to the compensation parameter of the distance sensor to acquire a compensated operating parameter of the target display circuit.

For example, the operating parameter of the target display circuit may be compensated according to the compensation parameter of the distance sensor to acquire the compensated operating parameter of the target display circuit in the following manner. The compensation parameter of the distance sensor and the operating parameter of the target display circuit may be substituted into a preset compensation algorithm of the distance sensor for calculation, and the compensated operating parameter of the target display circuit may be acquired according to the calculation result. Alternatively, a query may be performed in a sensor compensation database according to the compensation parameter of the distance sensor and the operating parameter of the target display circuit, and the compensated operating parameter of the target display circuit may be acquired according to the query result. The sensor compensation database indicates a correspondence relationship among compensation parameters of the distance sensor, operating parameters of the target display circuit and compensated operating parameters of the target display circuit.

The compensated operating parameter is used to control the target display circuit to display according to the compensated operating parameter.

For example, the operating parameter of the target display circuit includes an operating voltage $V_{data}$ of the target display circuit, a brightness value Br of the target display circuit, a gamma value γ of the target display circuit, and an operating voltage $V_{max}$ at the maximum brightness value of the target display circuit.

A compensation parameter of the distance sensor may be acquired according to the operation time period in the following manner. When the operation time period is greater than or equal to 100 hours and less than 200 hours, the compensation parameter of the distance sensor may be between 0.8 and 0.9, more specifically, the compensation parameter is determined as n=0.8458; when the operation time period is greater than or equal to 200 hours and less than 300 hours, the compensation parameter of the distance sensor may be between 1.8 and 1.9, more specifically, the compensation parameter is determined as n=1.8458; and when the operation time period is greater than or equal to 300 hours, the compensation parameter of the distance sensor is determined as n=2.8458.

The operating parameter of the target display circuit may be compensated according to the compensation parameter of the distance sensor to acquire the compensated operating parameter of the target display circuit in the following manner. When the operation time period is greater than or equal to 100 hours, the compensated operating voltage $V_c$ of the target display circuit is acquired according to $$V_c = V_{data} + \left(\frac{(Br*m+n)}{65025}\right)^{\gamma} * \left(\frac{Br}{255}\right) * V_{max} * V_{data},$$

where m is a constant, and n is the compensation parameter of the distance sensor. The constant may be m=0.0009754. Here, n is a parameter that may be fitted from the previously recorded test experiments. The specific value of n may be determined based on both the screen organic luminescent material and the sensor emission wavelength. For a specific hardware device, when the screen and sensor are determined, the initial value of n is fixed, and the subsequent changes with time.

In the technical solution provided by the embodiment of the present disclosure, an operating parameter of a target display circuit at a position on a display screen corresponding to the position of the distance sensor is acquired. The target display circuit may be understood as a display circuit that may be influenced or damaged on the display screen when the distance sensor performs distance measurement. An operation time period of the distance sensor is acquired, and a compensation parameter of the distance sensor is acquired according to the operation time period. The compensation parameter of the distance sensor is positively correlated to the operation time period. Therefore, the compensation parameter of the distance sensor can reflect the influence or damage caused to the target display circuit during the distance measurement performed by the distance sensor. The operating parameter of the target display circuit is compensated according to the compensation parameter of the distance sensor to acquire a compensated operating parameter of the target display circuit. Then, when the electronic device controls the target display circuit to display according to the compensated operating parameter, the influence or damage caused to the target display circuit by the distance sensor can be compensated, such that the display effect will not reflect the influence or damage caused to the target display circuit by the distance sensor, thereby improving the user experience.

Figure 2B:
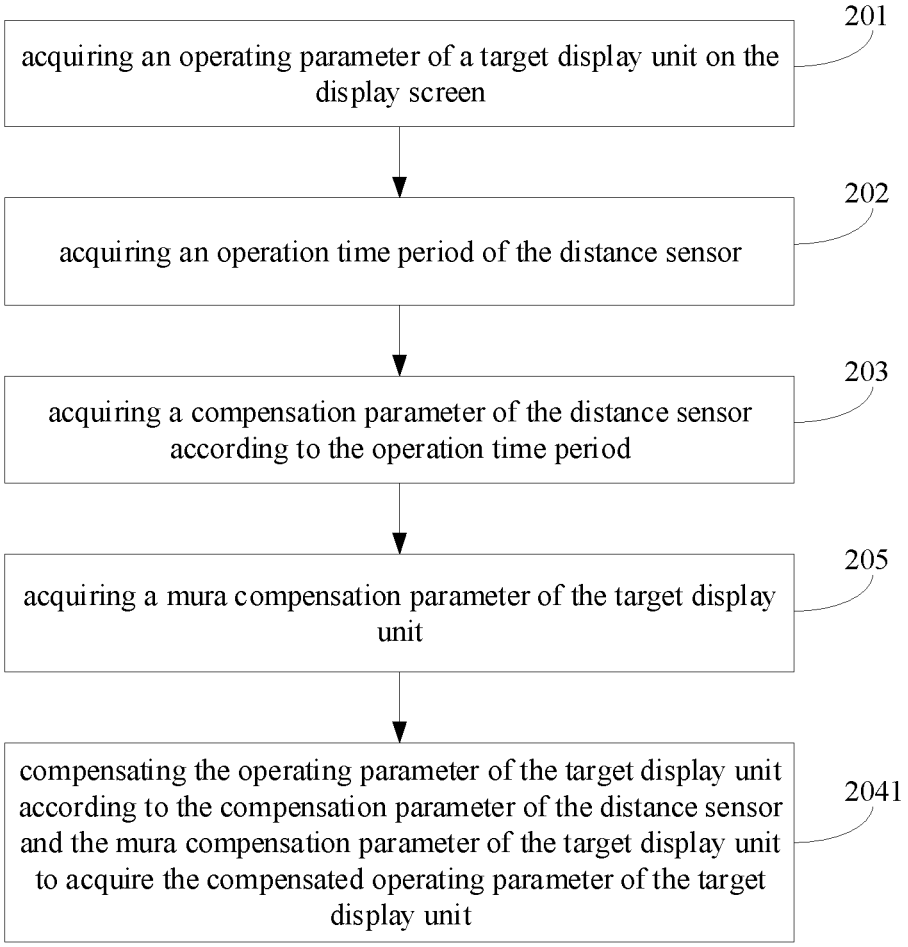
FIG. 2B is a flow chart of a display circuit operating parameter compensation method according to an exemplary embodiment.

In one embodiment, as shown in FIG. 2B, the method for compensating an operating parameter of a display circuit provided by the embodiment of the present disclosure further includes the following step 205.

In step 205, a mura compensation parameter of the target display circuit is acquired.

For example, the mura compensation parameter of the target display circuit may be acquired in the following manner. A query may be performed in a mura compensation parameter database according to a position parameter of the target display circuit, and the mura compensation parameter of the target display circuit may be acquired according to the query result. The mura compensation parameter database indicates a correspondence relationship between position parameters of the target display circuit and mura compensation parameters.

In step 204, the operating parameter of the target display circuit is compensated according to the compensation parameter of the distance sensor to acquire a compensated operating parameter of the target display circuit. This step may be implemented by step 2041.

In step 2041, the operating parameter of the target display circuit is compensated according to the compensation parameter of the distance sensor and the mura compensation parameter of the target display circuit to acquire the compensated operating parameter of the target display circuit.

The operating parameter of the target display circuit may be compensated according to the compensation parameter of the distance sensor and the mura compensation parameter of the target display circuit to acquire the compensated operating parameter of the target display circuit in the following manner. The compensation parameter of the distance sensor and the operating parameter of the target display circuit are substituted into a preset compensation algorithm of the distance sensor for calculation, and the compensated operating parameter of the target display circuit may be acquired according to the calculation result. Alternatively, a query may be performed in a sensor compensation database according to the compensation parameter of the distance sensor and the operating parameter of the target display circuit, and the compensated operating parameter of the target display circuit may be acquired according to the query result. The sensor compensation database indicates a correspondence relationship among compensation parameters of the distance sensor, operating parameters of the target display circuit and compensated operating parameters of the target display circuit.

For example, the operating parameter of the target display circuit may be compensated according to the compensation parameter of the distance sensor and the mura compensation parameter of the target display circuit to acquire the compensated operating parameter of the target display circuit in the following manner. The compensated operating voltage $V_c$ of the target display circuit may be acquired according to $$V_c = V_{data} + \left(\frac{(Br*m+n)}{65025}\right)^{\gamma} * \left(\frac{Br}{255}\right) * V_{max} * (V_{data} + V_{mura}).$$

The following is an apparatus embodiment of the present disclosure, which may be used to implement the method embodiments of the present disclosure.

Figure 3A:
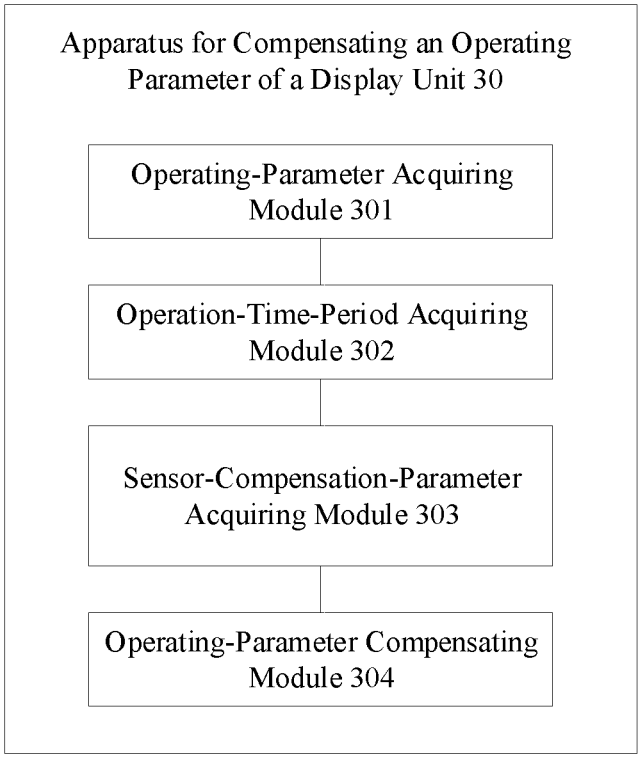
FIG. 3A is a block diagram of an apparatus for compensating an operating parameter of a display circuit according to an exemplary embodiment.

FIG. 3A is a block diagram of an apparatus 30 for compensating an operating parameter of a display circuit according to an exemplary embodiment. The apparatus 30 for compensating an operating parameter of a display circuit may be a terminal or a part of a terminal, and the apparatus 30 for compensating an operating parameter of a display circuit may be implemented as part or all of the electronic device by software, hardware or a combination of both. As shown in FIG. 3, the apparatus 30 for compensating an operating parameter of a display circuit includes:

an operating-parameter acquiring module 301 configured to acquire an operating parameter of a target display circuit on the display screen, the target display circuit being disposed at a position corresponding to a position of the distance sensor;

an operation-time-period acquiring module 302 configured to acquire an operation time period of the distance sensor;

a sensor-compensation-parameter acquiring module 303 configured to acquire a compensation parameter of the distance sensor according to the operation time period, the compensation parameter of the distance sensor being positively correlated to the operation time period; and an operating-parameter compensating module 304 configured to compensate the operating parameter of the target display circuit according to the compensation parameter of the distance sensor to acquire a compensated operating parameter of the target display circuit.

Figure 3B:
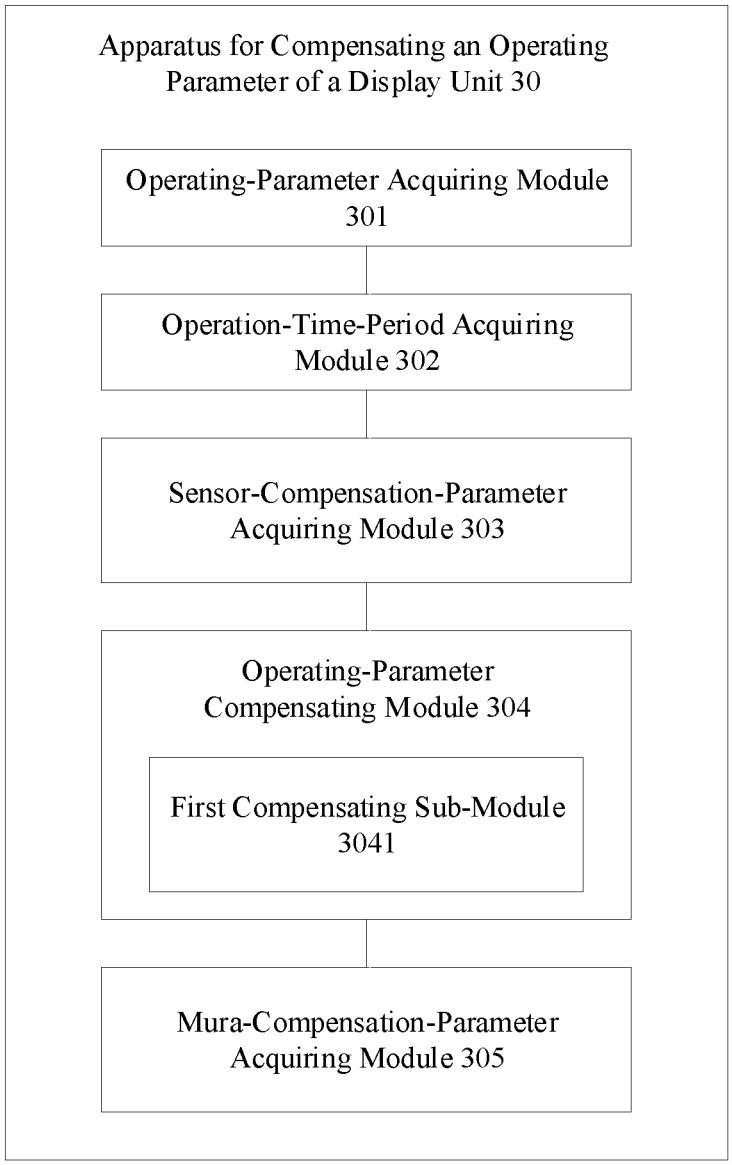
FIG. 3B is a block diagram of an apparatus for compensating an operating parameter of a display circuit according to an exemplary embodiment.

In an embodiment, as shown in FIG. 3B, apparatus 30 for compensating an operating parameter of a display circuit further includes:

a mura-compensation-parameter acquiring module 305 configured to acquire a mura compensation parameter of the target display circuit;

the operating-parameter compensating module 304 includes:

a first compensating sub-module 3041 configured to compensate the operating parameter of the target display circuit according to the compensation parameter of the distance sensor and the mura compensation parameter of the target display circuit to acquire the compensated operating parameter of the target display circuit.

Figure 3C:
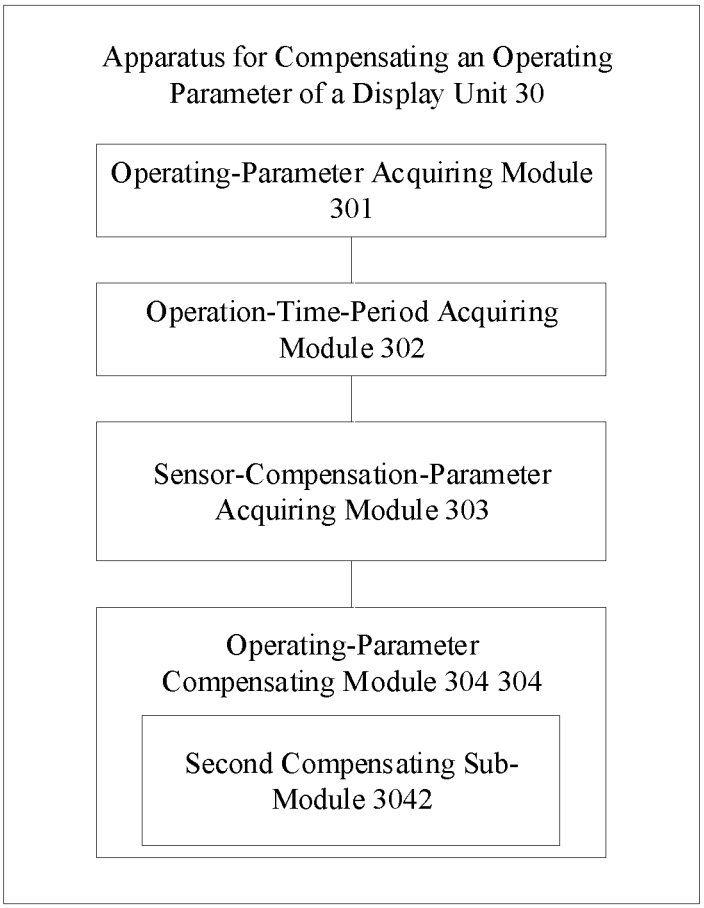
FIG. 3C is a block diagram of an apparatus for compensating an operating parameter of a display circuit according to an exemplary embodiment.

In an embodiment, the operating parameter of the target display circuit includes an operating voltage $V_{data}$ of the target display circuit, a brightness value Br of the target display circuit, a gamma value γ of the target display circuit, and an operating voltage $V_{max}$ at the maximum brightness value of the target display circuit; and as shown in FIG. 3C, the operating-parameter compensating module 304 includes:

a second compensating sub-module 3042 configured to acquire a compensated operating voltage $V_c$ of the target display circuit according to $$V_c = V_{data} + \left(\frac{(Br*m+n)}{65025}\right)^{\gamma} * \left(\frac{Br}{255}\right) * V_{max} * V_{data},$$

where m is a constant, and n is the compensation parameter of the distance sensor.

Figure 3D:
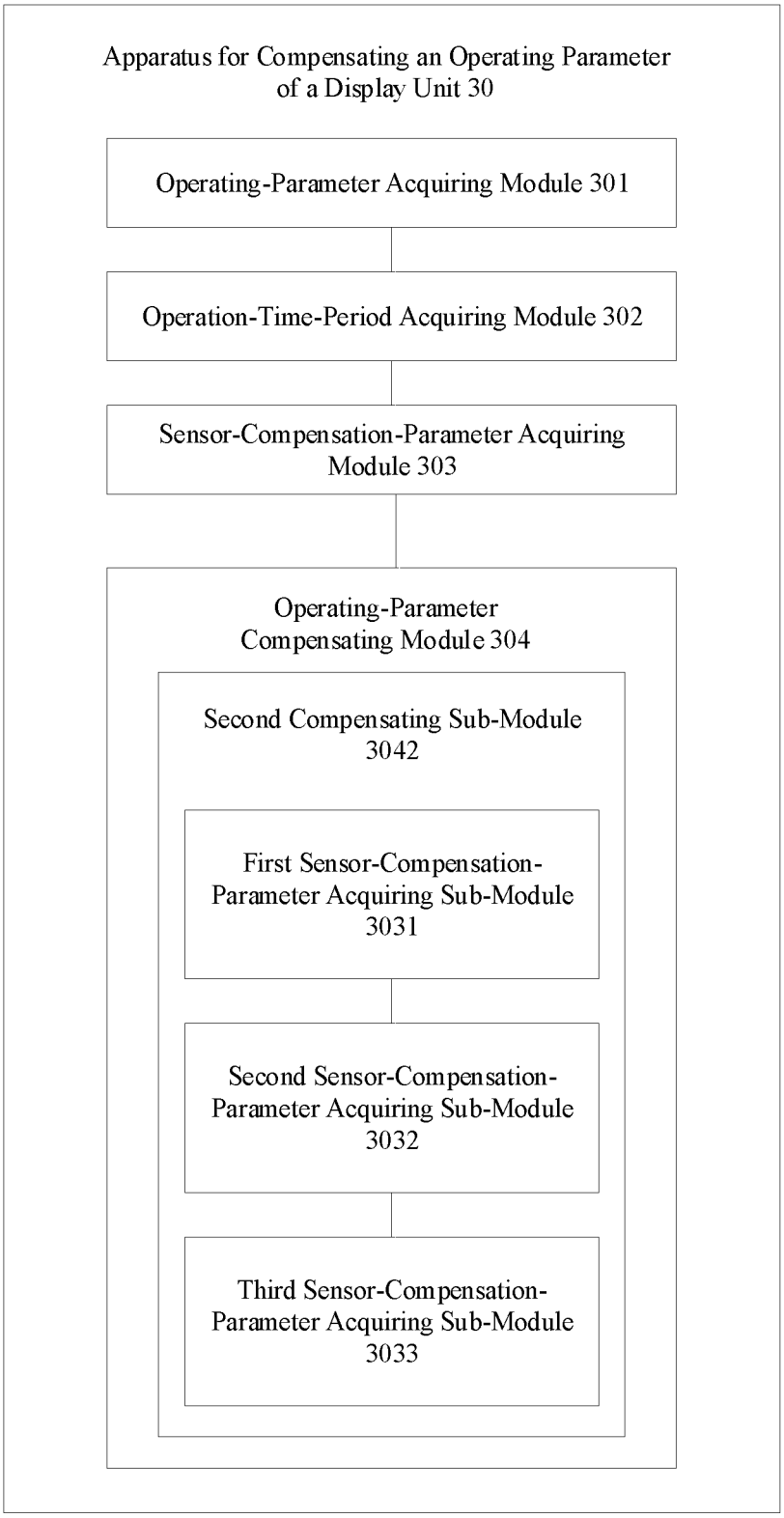
FIG. 3D is a block diagram of an apparatus for compensating an operating parameter of a display circuit according to an exemplary embodiment.

In an embodiment, as shown in FIG. 3D, the sensor-compensation-parameter acquiring module 303 includes:

a first sensor-compensation-parameter acquiring sub-module 3031 configured to, when the operation time period is greater than or equal to 100 hours and less than 200 hours, determine the compensation parameter of the distance sensor as n=0.8458;

a second sensor-compensation-parameter acquiring sub-module 3032 configured to, when the operation time period is greater than or equal to 200 hours and less than 300 hours, determine the compensation parameter of the distance sensor as n=1.8458; and a third sensor-compensation-parameter acquiring sub-module 3033 configured to, when the operation time period is greater than or equal to 300 hours, determine the compensation parameter of the distance sensor as n=2.8458.

In an embodiment, the constant m=0.0009754.

In the apparatus for compensating an operating parameter of a display circuit provided by the embodiment of the present disclosure, an operating parameter of a target display circuit at a position on a display screen corresponding to the position of the distance sensor is acquired. The target display circuit may be understood as a display circuit that may be influenced or damaged on the display screen when the distance sensor performs distance measurement. An operation time period of the distance sensor is acquired, and a compensation parameter of the distance sensor is acquired according to the operation time period. The compensation parameter of the distance sensor is positively correlated to the operation time period, therefore, the compensation parameter of the distance sensor can reflect the influence or damage caused to the target display circuit during the distance measurement performed by the distance sensor. The operating parameter of the target display circuit is compensated according to the compensation parameter of the distance sensor to acquire a compensated operating parameter of the target display circuit. Then, when the electronic device controls the target display circuit to display according to the compensated operating parameter, the influence or damage caused to the target display circuit by the distance sensor can be compensated, such that the display effect will not reflect the influence or damage caused to the target display circuit by the distance sensor, thereby improving the user experience.

Figure 4:
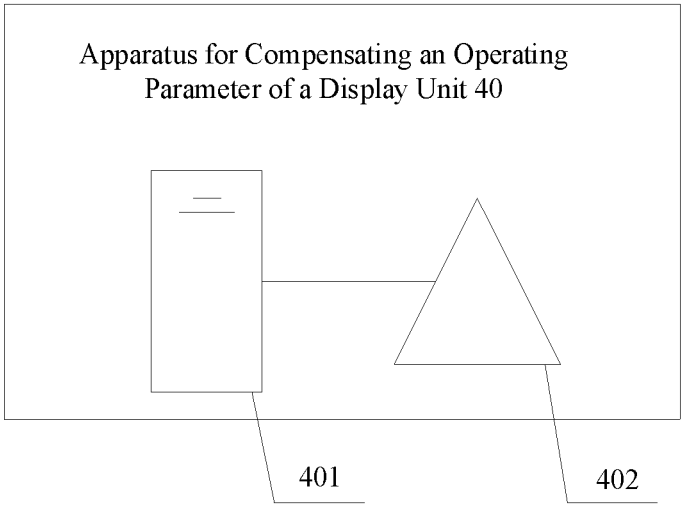
FIG. 4 is a block diagram of an apparatus according to an exemplary embodiment.

FIG. 4 is a block diagram of an apparatus 40 for compensating an operating parameter of a display circuit according to an exemplary embodiment. The apparatus 40 for compensating an operating parameter of a display circuit may be a terminal or a part of a terminal. The apparatus 40 for compensating an operating parameter of a display circuit includes:

a processor 401; and a memory 402 for storing instructions executable by the processor 401, wherein the processor 401 is configured to:

acquire an operating parameter of a target display circuit on the display screen, the target display circuit being disposed at a position corresponding to a position of the distance sensor;

acquire an operation time period of the distance sensor;

acquire a compensation parameter of the distance sensor according to the operation time period, the compensation parameter of the distance sensor being positively correlated to the operation time period; and compensate the operating parameter of the target display circuit according to the compensation parameter of the distance sensor to acquire a compensated operating parameter of the target display circuit.

In an embodiment, the processor 401 may be further configured to:

acquire a mura compensation parameter of the target display circuit;

compensating the operating parameter of the target display circuit according to the compensation parameter of the distance sensor to acquire a compensated operating parameter of the target display circuit includes:

compensating the operating parameter of the target display circuit according to the compensation parameter of the distance sensor and the mura compensation parameter of the target display circuit to acquire the compensated operating parameter of the target display circuit.

In an embodiment, the processor 401 may be further configured to: the operating parameter of the target display circuit includes an operating voltage $V_{data}$ of the target display circuit, a brightness value Br of the target display circuit, a gamma value γ of the target display circuit, and an operating voltage $V_{max}$ at the maximum brightness value of the target display circuit; and compensating the operating parameter of the target display circuit according to the compensation parameter of the distance sensor to acquire a compensated operating parameter of the target display circuit includes:

acquiring a compensated operating voltage $V_c$ of the target display circuit according to $$V_c = V_{data} + \left(\frac{(Br*m+n)}{65025}\right)^{\gamma} * \left(\frac{Br}{255}\right) * V_{max} * V_{data},$$

where m is a constant, and n is the compensation parameter of the distance sensor.

In an embodiment, the processor 401 may be further configured to: acquiring a compensation parameter of the distance sensor according to the operation time period includes:

when the operation time period is greater than or equal to 100 hours and less than 200 hours, determining the compensation parameter of the distance sensor as n=0.8458;

when the operation time period is greater than or equal to 200 hours and less than 300 hours, determining the compensation parameter of the distance sensor as n=1.8458; and when the operation time period is greater than or equal to 300 hours, determining the compensation parameter of the distance sensor as n=2.8458.

In an embodiment, the processor 401 may be further configured to: the constant m=0.0009754.

In the apparatus for compensating an operating parameter of a display circuit provided by the embodiment of the present disclosure, an operating parameter of a target display circuit at a position on a display screen corresponding to the position of the distance sensor is acquired. The target display circuit may be understood as a display circuit that may be influenced or damaged on the display screen when the distance sensor performs distance measurement. An operation time period of the distance sensor is acquired, and a compensation parameter of the distance sensor is acquired according to the operation time period. The compensation parameter of the distance sensor is positively correlated to the operation time period, therefore, the compensation parameter of the distance sensor can reflect the influence or damage caused to the target display circuit during the distance measurement performed by the distance sensor. The operating parameter of the target display circuit is compensated according to the compensation parameter of the distance sensor to acquire a compensated operating parameter of the target display circuit. Then, when the electronic device controls the target display circuit to display according to the compensated operating parameter, the influence or damage caused to the target display circuit by the distance sensor can be compensated, such that the display effect will not reflect the influence or damage caused to the target display circuit by the distance sensor, thereby improving the user experience.

Figure 5:
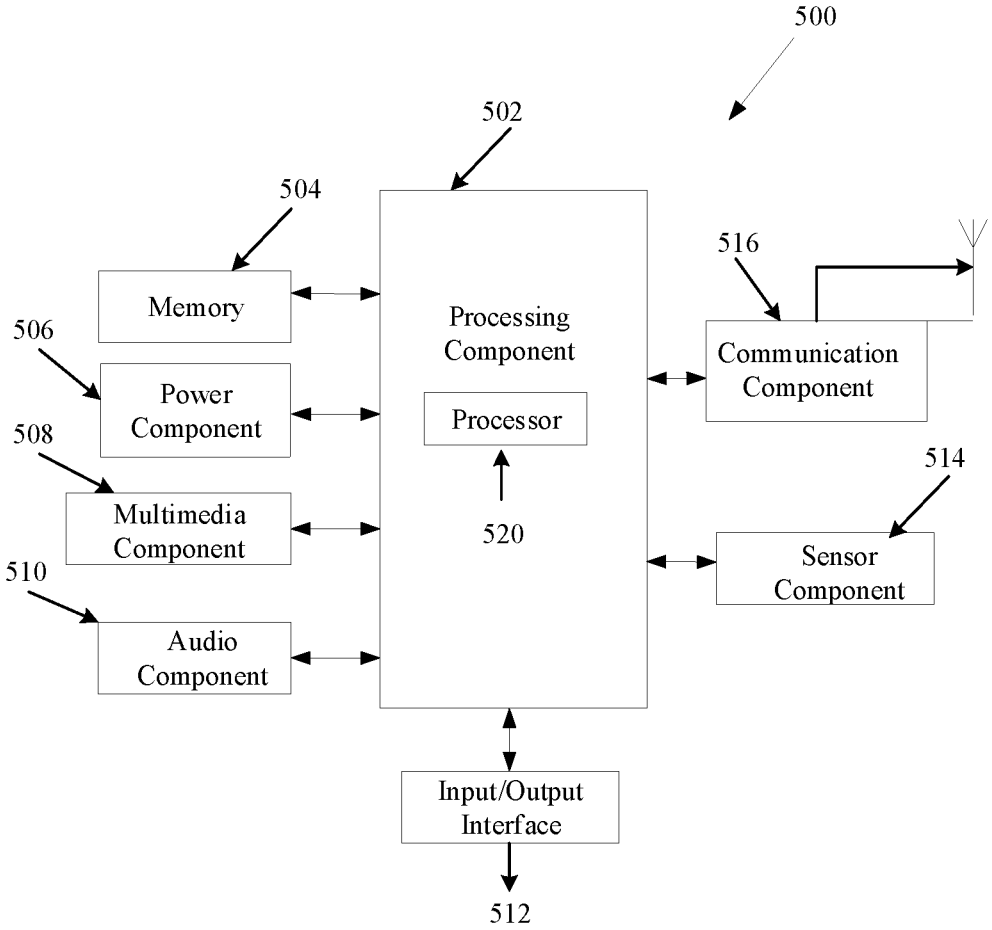
FIG. 5 is a block diagram of an apparatus according to an exemplary embodiment.

FIG. 5 is a block diagram of an apparatus 500 for compensating an operating parameter of a display circuit according to an exemplary embodiment. For example, the apparatus 500 may be a mobile phone, a computer, a digital broadcast terminal, a messaging device, a gaming console, a tablet, a medical device, exercise equipment, a personal digital assistant, and the like.

The apparatus 500 may include one or more of the following components: a processing component 502, a memory 504, a power component 506, a multimedia component 508, an audio component 510, an input/output (I/O) interface 512, a sensor component 514, and a communication component 516.

The processing component 502 typically controls overall operations of the apparatus 500, such as the operations associated with display, telephone calls, data communications, camera operations, and recording operations. The processing component 502 may include one or more processors 520 to execute instructions, to perform all or part of the steps of the above method. Moreover, the processing component 502 may include one or more modules which facilitate the interaction between the processing component 502 and other components. For instance, the processing component 502 may include a multimedia module to facilitate the interaction between the multimedia component 508 and the processing component 502.

The memory 504 is configured to store various types of data to support the operation of the apparatus 500. Examples of such data include instructions for any applications or methods operated on the apparatus 500, contact data, phonebook data, messages, pictures, video, etc. The memory 504 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 506 provides power to various components of the apparatus 500. The power component 506 may include a power management system, one or more power sources, and any other components associated with the generation, management, and distribution of power in the apparatus 500.

The multimedia component 508 includes a screen providing an output interface between the apparatus 500 and the user. In some embodiments, the screen may include a liquid crystal display (LCD) and a touch panel (TP). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some embodiments, the multimedia component 508 includes a front camera and/or a rear camera. The front camera and the rear camera may receive an external multimedia datum while the apparatus 500 is in an operation mode, such as a photographing mode or a video mode. Each of the front camera and the rear camera may be a fixed optical lens system or have focus and optical zoom capability.

The audio component 510 is configured to output and/or input audio signals. For example, the audio component 510 includes a microphone ("MIC") configured to receive an external audio signal when the apparatus 500 is in an operation mode, such as a call mode, a recording mode, and a voice recognition mode. The received audio signal may be further stored in the memory 504 or transmitted via the communication component 516. In some embodiments, the audio component 510 further includes a speaker to output audio signals.

The I/O interface 512 provides an interface between the processing component 502 and peripheral interface modules, such as a keyboard, a click wheel, buttons, and the like. The buttons may include, but are not limited to, a home button, a volume button, a starting button, and a locking button.

The sensor component 514 includes one or more sensors to provide status assessments of various aspects of the apparatus 500. For instance, the sensor component 514 may detect an open/closed status of the apparatus 500, relative positioning of components, e.g., the display and the keypad, of the apparatus 500, a change in position of the apparatus 500 or a component of the apparatus 500, a presence or absence of user contact with the apparatus 500, an orientation or an acceleration/deceleration of the apparatus 500, and a change in temperature of the apparatus 500. The sensor component 514 may include a proximity sensor configured to detect the presence of nearby objects without any physical contact. The sensor component 514 may also include a light sensor, such as a CMOS or CCD image sensor, for use in imaging applications. In some embodiments, the sensor component 514 may also include an accelerometer sensor, a gyroscope sensor, a magnetic sensor, a pressure sensor, or a temperature sensor.

The communication component 516 is configured to facilitate communication, wired or wirelessly, between the apparatus 500 and other devices. The apparatus 500 can access a wireless network based on a communication standard, such as WiFi, 2G, 3G, 4G or 5G, or a combination thereof. In one exemplary embodiment, the communication component 516 receives a broadcast signal or broadcast associated information from an external broadcast management system via a broadcast channel. In one exemplary embodiment, the communication component 516 further includes a near field communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology, and other technologies.

In exemplary embodiments, the apparatus 500 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, to perform the above method.

In exemplary embodiments, there is also provided a non-transitory computer-readable storage medium including instructions, such as included in the memory 504, executable by the processor 520 in the apparatus 500 to perform the above method for compensating an operating parameter of a display circuit. For example, the non-transitory computer-readable storage medium may be a ROM, a RAM, a CD-ROM, a magnetic tape, a floppy disc, an optical data storage device, and the like.

A non-transitory computer readable storage medium, when instructions (or computer program) in the storage medium are executed by the processor of the apparatus 500, causes the apparatus 500 to perform the above method for compensating an operating parameter of a display circuit. The method includes:

acquiring an operating parameter of a target display circuit on the display screen, the target display circuit being disposed at a position corresponding to a position of the distance sensor;

acquiring an operation time period of the distance sensor;

acquiring a compensation parameter of the distance sensor according to the operation time period, the compensation parameter of the distance sensor being positively correlated to the operation time period; and compensating the operating parameter of the target display circuit according to the compensation parameter of the distance sensor to acquire a compensated operating parameter of the target display circuit.

In an embodiment, the method further includes:

acquiring a mura compensation parameter of the target display circuit;

compensating the operating parameter of the target display circuit according to the compensation parameter of the distance sensor to acquire a compensated operating parameter of the target display circuit includes:

compensating the operating parameter of the target display circuit according to the compensation parameter of the distance sensor and the mura compensation parameter of the target display circuit to acquire the compensated operating parameter of the target display circuit.

In an embodiment, the operating parameter of the target display circuit includes an operating voltage $V_{data}$ of the target display circuit, a brightness value Br of the target display circuit, a gamma value γ of the target display circuit, and an operating voltage $V_{max}$ at the maximum brightness value of the target display circuit; and compensating the operating parameter of the target display circuit according to the compensation parameter of the distance sensor to acquire a compensated operating parameter of the target display circuit includes:

acquiring a compensated operating voltage $V_c$ of the target display circuit according to $$V_c = V_{data} + \left(\frac{(Br*m+n)}{65025}\right)^{\gamma} * \left(\frac{Br}{255}\right) * V_{max} * V_{data},$$

where m is a constant, and n is the compensation parameter of the distance sensor.

In an embodiment, acquiring a compensation parameter of the distance sensor according to the operation time period includes:

when the operation time period is greater than or equal to 100 hours and less than 200 hours, determining the compensation parameter of the distance sensor as n=0.8458;

when the operation time period is greater than or equal to 200 hours and less than 300 hours, determining the compensation parameter of the distance sensor as n=1.8458; and when the operation time period is greater than or equal to 300 hours, determining the compensation parameter of the distance sensor as n=2.8458.

In an embodiment, the constant m=0.0009754.

In the technical solution provided by the embodiment of the present disclosure, an operating parameter of a target display circuit at a position on a display screen corresponding to the position of the distance sensor is acquired. The target display circuit may be understood as a display circuit that may be influenced or damaged on the display screen when the distance sensor performs distance measurement. An operation time period of the distance sensor is acquired, and a compensation parameter of the distance sensor is acquired according to the operation time period. The compensation parameter of the distance sensor is positively correlated to the operation time period. Therefore, the compensation parameter of the distance sensor can reflect the influence or damage caused to the target display circuit during the distance measurement performed by the distance sensor. The operating parameter of the target display circuit is compensated according to the compensation parameter of the distance sensor to acquire a compensated operating parameter of the target display circuit. Then, when the electronic device controls the target display circuit to display according to the compensated operating parameter, the influence or damage caused to the target display circuit by the distance sensor can be compensated, such that the display effect will not reflect the influence or damage caused to the target display circuit by the distance sensor, thereby improving the user experience.

Other embodiments of the disclosure will be apparent to those skilled in the art from consideration of the specification and practice of the disclosure disclosed here. This application is intended to cover any variations, uses, or adaptations of the disclosure following the general principles thereof and including such departures from the present disclosure as come within known or customary practice in the art. It is intended that the specification and examples be considered as exemplary only, with a true scope and spirit of the disclosure being indicated by the following claims.

It will be appreciated that the present disclosure is not limited to the exact construction that has been described above and illustrated in the accompanying drawings, and that various modifications and changes may be made without departing from the scope thereof. It is intended that the scope of the disclosure only be limited by the appended claims.

What is claimed is:

1. A method for compensating an operating parameter of a display circuit, the method comprising:

acquiring, by an electronic device comprising a display screen and a distance sensor disposed under the display screen, an operating parameter of a target display circuit on the display screen, the target display circuit being disposed at a position corresponding to a position of the distance sensor;

acquiring an operation time period of the distance sensor;

acquiring a compensation parameter of the distance sensor according to the operation time period, the compensation parameter of the distance sensor being positively correlated to the operation time period; and compensating the operating parameter of the target display circuit according to the compensation parameter of the distance sensor to acquire a compensated operating parameter of the target display circuit.

2. The method according to claim 1, further comprising:

acquiring a mura compensation parameter of the target display circuit;

compensating the operating parameter of the target display circuit according to the compensation parameter of the distance sensor and the mura compensation parameter of the target display circuit to acquire the compensated operating parameter of the target display circuit.

3. The method according to claim 1, wherein the operating parameter of the target display circuit comprises an operating voltage $V_{data}$ of the target display circuit, a brightness value Br of the target display circuit, a gamma value γ of the target display circuit, and an operating voltage $V_{max}$ at the maximum brightness value of the target display circuit.

4. The method according to claim 3, wherein compensating the operating parameter of the target display circuit according to the compensation parameter of the distance sensor to acquire a compensated operating parameter of the target display circuit comprises:

acquiring a compensated operating voltage $V_c$ of the target display circuit according to $$V_c = V_{data} + \left(\frac{(Br*m+n)}{65025}\right)^{\gamma} * \left(\frac{Br}{255}\right) * V_{max} * V_{data},$$

where m is a constant, and n is the compensation parameter of the distance sensor.

5. The method according to claim 4, wherein acquiring a compensation parameter of the distance sensor according to the operation time period comprises:

when the operation time period is greater than or equal to 100 hours and less than 200 hours, determining the compensation parameter of the distance sensor as n=0.8458; and when the operation time period is greater than or equal to 200 hours and less than 300 hours, determining the compensation parameter of the distance sensor as n=1.8458.

6. The method according to claim 4, wherein the constant m=0.0009754.

7. An apparatus for compensating an operating parameter of a display circuit, comprising:

a processor; and a memory for storing instructions executable by the processor, wherein the processor is configured to:

acquire an operating parameter of a target display circuit on a display screen, the target display circuit being disposed at a position corresponding to a position of a distance sensor;

acquire an operation time period of the distance sensor;

acquire a compensation parameter of the distance sensor according to the operation time period, the compensation parameter of the distance sensor being positively correlated to the operation time period; and compensate the operating parameter of the target display circuit according to the compensation parameter of the distance sensor to acquire a compensated operating parameter of the target display circuit.

8. The apparatus according to claim 7, wherein the processor is further configured to:

acquire a mura compensation parameter of the target display circuit; and compensating the operating parameter of the target display circuit according to the compensation parameter of the distance sensor to acquire a compensated operating parameter of the target display circuit comprises:

compensating the operating parameter of the target display circuit according to the compensation parameter of the distance sensor and the mura compensation parameter of the target display circuit to acquire the compensated operating parameter of the target display circuit.

9. The apparatus according to claim 7, wherein the operating parameter of the target display circuit comprises an operating voltage $V_{data}$ of the target display circuit, a brightness value Br of the target display circuit, a gamma value γ of the target display circuit, and an operating voltage V $max_{max}$ at the maximum brightness value of the target display circuit; and compensating the operating parameter of the target display circuit according to the compensation parameter of the distance sensor to acquire a compensated operating parameter of the target display circuit comprises:

acquiring a compensated operating voltage $V_c$ of the target display circuit according to $$V_c = V_{data} + \left(\frac{(Br*m+n)}{65025}\right)^{\gamma} * \left(\frac{Br}{255}\right) * V_{max} * V_{data},$$

where m is a constant, and n is the compensation parameter of the distance sensor.

10. The apparatus according to claim 8, wherein acquiring the compensation parameter of the distance sensor according to the operation time period comprises:

when the operation time period is greater than or equal to 100 hours and less than 200 hours, determining the compensation parameter of the distance sensor as n, where n=0.8458.

11. The apparatus according to claim 10, wherein acquiring the compensation parameter of the distance sensor according to the operation time period comprises:

when the operation time period is greater than or equal to 200 hours and less than 300 hours, determining the compensation parameter of the distance sensor as n=1.8458.

12. The apparatus according to claim 9, wherein the constant m=0.0009754.

13. A non-transitory computer readable storage medium having stored thereon computer instructions, wherein the instructions are executed by a processor, the processor is caused to perform acts comprising:

acquiring an operating parameter of a target display circuit on a display screen, the target display circuit being disposed at a position corresponding to a position of a distance sensor;

acquiring an operation time period of the distance sensor;

acquiring a compensation parameter of the distance sensor according to the operation time period, the compensation parameter of the distance sensor being positively correlated to the operation time period; and compensating the operating parameter of the target display circuit according to the compensation parameter of the distance sensor to acquire a compensated operating parameter of the target display circuit.

14. The non-transitory computer readable storage medium according to claim 13, wherein the processor is caused to further perform acts comprising:

acquiring a mura compensation parameter of the target display circuit; and compensating the operating parameter of the target display circuit according to the compensation parameter of the distance sensor and the mura compensation parameter of the target display circuit to acquire the compensated operating parameter of the target display circuit.

15. The non-transitory computer readable storage medium according to claim 13, wherein the operating parameter of the target display circuit comprises an operating voltage $V_{data}$ of the target display circuit, a brightness value Br of the target display circuit, a gamma value γ of the target display circuit, and an operating voltage $V_{max}$ at the maximum brightness value of the target display circuit.

16. The non-transitory computer readable storage medium according to claim 15, wherein compensating the operating parameter of the target display circuit according to the compensation parameter of the distance sensor to acquire a compensated operating parameter of the target display circuit comprises:

acquiring a compensated operating voltage $V_c$ of the target display circuit according to $$V_c = V_{data} + \left(\frac{(Br*m+n)}{65025}\right)^{\gamma} * \left(\frac{Br}{255}\right) * V_{max} * V_{data},$$

where m is a constant, and n is the compensation parameter of the distance sensor.

17. The non-transitory computer readable storage medium according to claim 16, wherein acquiring a compensation parameter of the distance sensor according to the operation time period comprises:

when the operation time period is greater than or equal to 100 hours and less than 200 hours, determining the compensation parameter of the distance sensor as n=0.8458;

when the operation time period is greater than or equal to 200 hours and less than 300 hours, determining the compensation parameter of the distance sensor as n=1.8458.

18. The non-transitory computer readable storage medium according to claim 16, wherein the constant m=0.0009754.

* * * * *